United States Patent [19]

Barber et al.

[11] 4,125,579

[45] Nov. 14, 1978

[54] CONCRETE PIPE FORMING MACHINE

[75] Inventors: Thomas W. Barber, El Toro; Miles W. Proctor, Santa Ana, both of Calif.

[73] Assignee: Donovan Construction Company, Irvine, Calif.

[21] Appl. No.: 762,064

[22] Filed: Jan. 24, 1977

Related U.S. Application Data

[62] Division of Ser. No. 590,257, Jun. 25, 1975, abandoned.

[51] Int. Cl.[2] ..... E04B 1/16

[52] U.S. Cl. ..... 264/32; 264/33; 264/35; 425/59

[58] Field of Search ..... 264/32, 35, 70, 33; 425/59

[56] References Cited

U.S. PATENT DOCUMENTS

| | | | |
|---|---|---|---|
| 291,849 | 1/1884 | Howson | 264/33 |
| 1,778,099 | 10/1930 | Webb | 425/59 X |
| 1,867,837 | 7/1932 | Jackson | 425/59 X |
| 2,256,235 | 9/1941 | Breedlove | 264/33 |
| 2,753,220 | 7/1956 | Kemper | 425/59 X |
| 3,193,901 | 7/1965 | Lee | 425/59 |
| 3,492,395 | 1/1970 | Breitfuss | 264/32 X |

*Primary Examiner*—Thomas P. Pavelko

*Attorney, Agent, or Firm*—Knobbe, Martens, Olson, Hubbard & Bear

[57] ABSTRACT

A slip form apparatus for the in place formation of a continuous concrete pipe in an open trench. The concrete material is supplied under high pressure to obtain a good and uniformly compacted pipe. The apparatus is automatically moved forward along the trench only when a properly compacted continuous pipe is being formed within the apparatus. Provided in the construction of the apparatus is the ability to temporarily stop the movement and formation of the pipe and then subsequently continue with the formation of the pipe without having to remove the apparatus from the trench. Also utilized in conjunction with the apparatus is a unique deployment arrangement for an inflatable film means located at a stationary position behind the apparatus to automatically supply support for the wet cementitious material as the pipe is being formed along the trench.

2 Claims, 6 Drawing Figures

CONCRETE PIPE FORMING MACHINE

This is a division of application Ser. No. 590,257, filed June 25, 1975, now abandoned.

BACKGROUND OF THE INVENTION

This invention relates generally to the field of in place formation of concrete pipes in an open trench for utilization in the transporting of water, sewage, irrigation, etc. Typically, a passageway for transporting any liquid or gas is constructed by the connection of several sections of precast cementitious or concrete pipe which are placed in an open trench and covered. Such precast concrete pipe results in a large amount of joint junctures which must be properly sealed and pose potential leakage areas. Furthermore, the utilization of precast pipe is quite expensive and its placement in the trench is very time consuming.

In the prior art some devices are disclosed which provide for the in place formation of a continuous concrete pipe. However, most of these devices are quite complicated in their construction and operation and do not provide a satisfactory end product for several reasons. One primary problem relates to the lack of proper compaction in the placement of the concrete around the form area, so that there are no weak spots or leakage areas in the continuous run of the in place pipe. This results from the fact that most prior art approaches utilize a gravity feed system in supplying the concrete around the pipe form. Two known prior art devices (Lee, et al, U.S. Pat. No. 3,193,901 and Johnson, et al, U.S. Pat. No. 3,785,759) have considered the placement of concrete in the pipe form under somewhat greater force than gravity. However, both the Johnson ramming device and the Lee auger screw arrangement are extremely complex and expensive in their construction, and believed to be impractical. Furthermore, there is no means available in these devices to check from within the forming apparatus itself the compaction of the concrete at the bottom of the newly formed pipe during the formation process. Consequently, after the concrete has set up sufficiently and the internal support can be removed, defects in the formation of the pipe are noted, requiring someone to patch certain areas where the proper amount of concrete was not placed along the run of the formed pipe.

Another area of significant concern in prior art devices relates to the utilization of a satisfactory and inexpensive support arrangement to occupy the interior area of the pipe and hold it in place while the concrete is being set. Several of these prior art devices use rather complicated fixed form devices which do not provide a smooth interior surface resulting in a variation of pipe internal diameter. Furthermore, the placement of these support devices is time consuming and severely affects the efficiency of the in place forming of the concrete.

Prior art in place concrete forming devices utilize a moving means which is not controlled by the placement of the concrete in the apparatus and, therefore, the apparatus may move forward at a rate which is not proper to provide adequate compaction along the run of the pipe. In many instances, this is due to the fact that, since the trench itself provides the outer form for the concrete pipe, various amounts of concrete are needed as the apparatus proceeds along the trench because of irregular trench configuration. Again when this improper compaction occurs, it is necessary to do patch work after the complete run is finished.

A further problem with prior art devices in this field is directed to the ability to temporarily stop the movement of the apparatus along the trench and then reinstitute movement after a short delay without having to completely remove the device from within the trench. The reason most prior art devices require the removal of the apparatus is to avoid the concrete setting up around the device and locking it within the concrete in the trench.

SUMMARY OF THE INVENTION

The device disclosed herein comprises a support member with a mandrel and an upper skirt which receives concrete from a concrete pump which provides adequate compaction and moves the device forward in a trench only as the proper compaction of the concrete pipe is established. The support member is a half cylindrical member having a circular collar with a retaining ring for use against the leading edge of the in place concrete pipe during temporary removal of the mandrel. The mandrel provides the interior forming support for the pipe. Connected to the support member and located generally over the mandrel in a spaced relation is a skirt member which provides an exterior form member.

Because the entire forming apparatus moves along as the pipe is being formed, the operation is essentially a slip form procedure. The forward movement of the mandrel gives a smooth desirable interior surface of the formed pipe.

The high pressure concrete pump introduces the concrete at the necessary pressure and force to properly place the adequate amount of concrete in compacted form around the mandrel below the skirt. Furthermore, the force of the concrete being placed around the mandrel presses against the retaining ring on the support member and forces it to move forward in the trench when enough concrete has been placed around the mandrel to form a properly compacted in place pipe. Also the pump is up out of the trench where it does not add to the weight to be moved in the trench, is not in the way, and is standard equipment usable for other purposes. However, the concrete pump could be placed at either end of the run of pipe to be made or in the trench itself if desired.

The utilization of the retaining ring on the support member allows for the temporary partial removal of the mandrel during a temporary stoppage in work without having to completely remove the mandrel or the support member from within the trench adjacent the pipe. Consequently, much time is saved during a temporary stop of an hour or two, or even an overnight stop, since it is not necessary to remove and then replace the device in the trench.

A flexible support bag is anchored at a stationary position at the starting point when forming the in place concrete and deploys within the interior of the newly formed concrete pipe with enough pressure to provide adequate support in order to allow the pipe to properly set. The placement of the undeployed portion of the support bag to the rear of the forming apparatus rather than in the apparatus eliminates congestion within the apparatus itself. This provides the ability to have viewing ports within the mandrel to observe during the forming process whether the properly compacted concrete is being placed around the mandrel. By positioning the deployment bag at a fixed location separate from the moving portion of the apparatus, there is no need for a moving seal which would be required if the support bag were situated within the forming apparatus itself as shown in the prior art.

The ability to form in place concrete pipe in a continuous run along a trench eliminates the utilization of expensive precast concrete pipe and also greatly increases the efficiency in placement of a concrete pipe, because such an in place forming process is extremely efficient and time saving.

DETAILED DESCRIPTION OF THE INVENTION

Figures 1, 2:
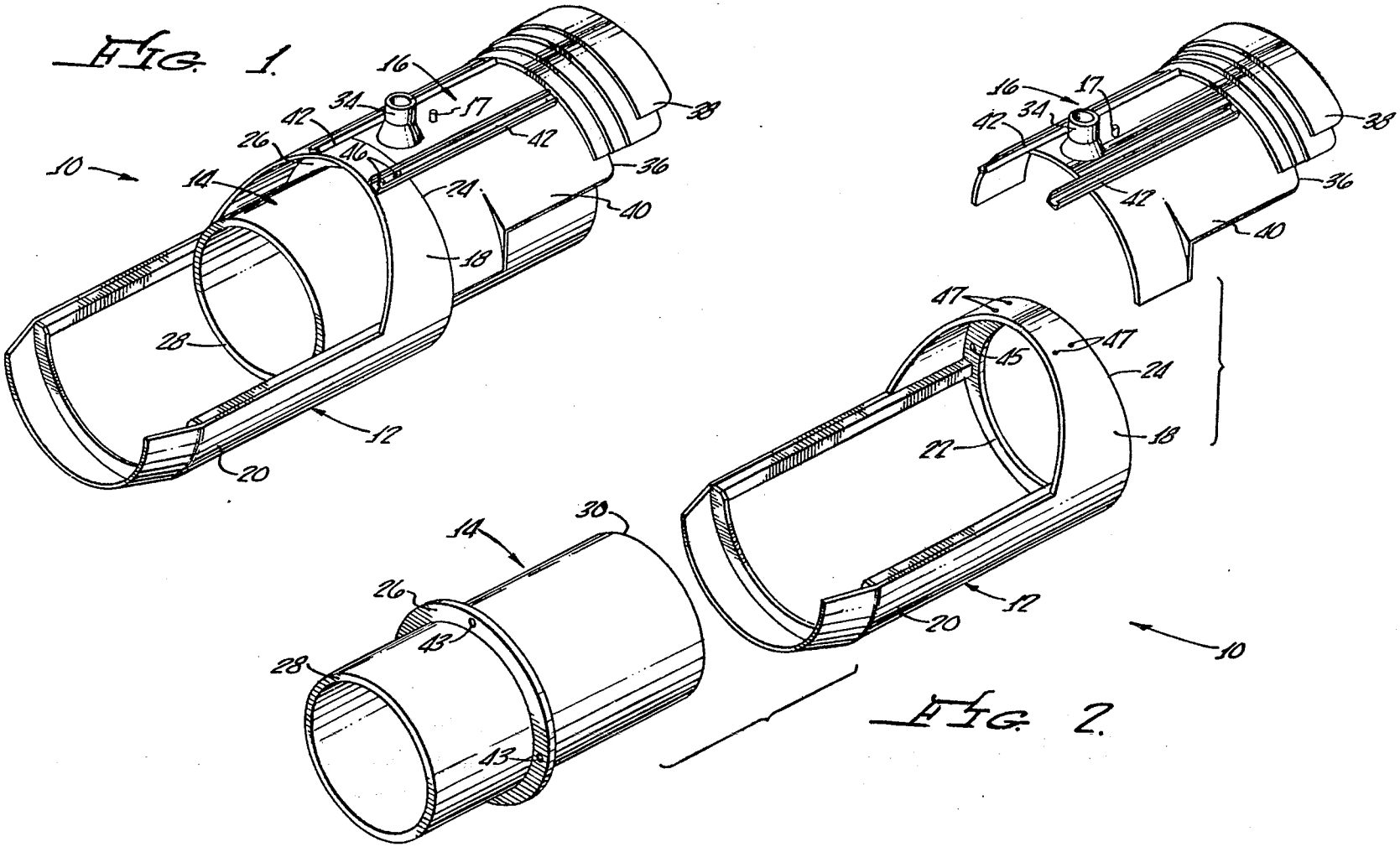
FIG. 1 is a perspective view of the forming apparatus.
FIG. 2 is a partially exploded perspective view of the main parts of the forming apparatus.

FIGS. 1 and 2 show the primary elements of the forming apparatus 10, namely a base support member 12, a mandrel 14, and a skirt 16. The base support member or boat 12 has a cylindrical ring or collar 18 at one end with an outwardly extending half cylindrical forward section 20. A circular retaining flange 22 extends inwardly radially from the back edge 24 of the cylindrical ring 18. The base support member 12 is designed to slide along the bottom of the trench during the placement of the concrete pipe. The mandrel 14 is a hollow cylindrical drum having a circular connecting flange 26 toward its forward end 28. The portion of the mandrel 14 on the side of the connecting ring or flange 26 away from the forward end 28 acts as the interior forming member during the placement of the concrete pipe. Being hollow, the mandrel's forward end 28 is open while the rear side 30 is closed.

The skirt 16 is a generally half cylindrical sectional portion which provides an exterior forming member during the placement of the continuous concrete pipe. Located on top of the skirt 16 is an entry port 34 for receipt of a hose 58 in FIG. 5 which supplies the concrete from the concrete pump 54. Adjacent the back edge 36 of the skirt 16 on FIG. 2 is a tapered flange arrangement 38 which is designed to provide a gradual release of the high pressure concrete as it forces its way out from under the rear edge 36 of the skirt. Otherwise, the concrete may tend to be forced out too violently affecting the overall compaction desired. Also located along the longitudinal sides of the skirt 16 are tapered longitudinal flanges or edges 40 which provide better compaction of the concrete between the skirt and the mandrel as well as between the mandrel and the trench wall. Extending along the top portion of the skirt 16 are connecting bars 42. Also located on the skirt 16 are small relief ports 17 which provide vents for air which becomes entrapped under the skirt when the high pressure concrete enters through the entry port 34.

Figure 3:
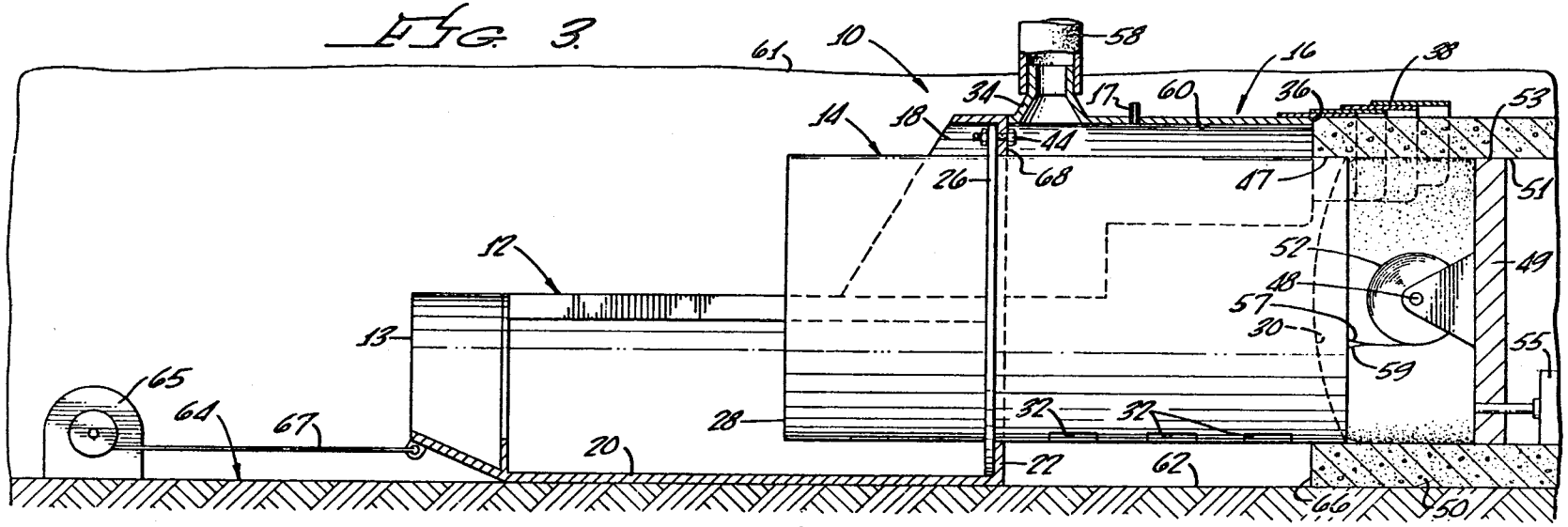
FIG. 3 is a partial side sectional view of the forming apparatus in the trench prior to operation.

With respect to the assembly of the mandrel 14 and the skirt 16 to the base support member 12, reference is made to FIGS. 1 and 3. The mandrel 14 is connected to the base support member 12 by the joining of the connecting ring 26 on the mandrel 14 as shown in FIG. 3 to the retaining ring 22 of the base support member 12. This is done through the utilization of a series of bolts 44 extending through the respective holes 43 and 45 in the connecting flange 26 and retaining flange 22. As shown in FIGS. 1 and 2, the skirt 16 is attached by the attachment bars 42 to the upper side of the cylindrical collar 18 on the base support member 12. The bolts 46 extending through the connecting bars 42 and into the holes 47 in the cylindrical ring 18 provide for secure connection of the skirt 16 in a spaced relation with the mandrel as shown more clearly in FIG. 3.

As shown in FIG. 3, a deployment reel 48 is anchored on a bulkhead 49 set in a stationary precast section of pipe 50 which establishes the starting point for the in place formation of a continuous run of concrete pipe. Mounted on the reel 48 is a pliable deployment bag 52 which is designed to deploy behind the back surface 30 of the mandrel 14 as it proceeds forward with the forming of the in place pipe. The bag is a flexible tubular member preferably of thin, plastic film with an open end 51 whch is sealed at the junction 53 between the bulkhead 49 and the interior surface 47 precast section of pipe 50. It should be noted that the open end 51 of the bag could be sealed anywhere along the interior surface 47 of the precast section of pipe so away from the bulkhead 49 by glue or some other attaching means. The closed end of the bag is rolled up inside itself on the reel 48. The bag deploys and expands to occupy the interior diameter of the newly formed pipe to provide adequate support of the pipe until the concrete has set. The bag 52 receives a specified amount of air pressure which is slightly greater than exterior pressure on the newly formed pipe in order to maintain adequate support of the pipe. The air pressure source 55 also provides the activating force to move the deployment bag along behind the mandrel 14, as it proceeds forward, and unrolls the bag 52 off the reel 48. Being rolled up inside itself, the bag 52 comes off the reel 48 with two travelling surfaces 57 and 59 which are in face-to-face contact at first. As the mandrel moves forward, the upper surface 57 with respect to FIGS. 3 and 4 moves into contact with the back surface 30 of the mandrel and then proceeds up closely along the back surface 30 and into contact with the interior surfaces 47 and 43 of the respective precast and formed pipe 50 and 45 closer to the upper edge 61 of the trench. Similarly, the lower surface 59 of the bag 52 moves into contact with the back surface 30 of the mandrel and then proceeds down closely along the back surface 30 to contact the interior surface of the pipe closer to the bottom 64 of the trench. The progression of the inflated bag from the FIG. 3 position to the FIG. 4 position shows clearly how the respective faces 57 and 59 of the bag 52 continually proceed into contact with the interior surface 43 of the newly formed pipe 45 as the mandrel moves forward. The air pressure which is inflating the bag provides the necessary support for the new pipe. It should be noted that the reel 48 could be oriented several different ways rather than the general horizontal orientation of FIG. 3. A change in the reel orientation would, of course, change the orientation of the bag surfaces 57 and 59. Also, the back surface 30 of the mandrel 14 is concave to provide better conformity with the bag 52.

Figure 5:
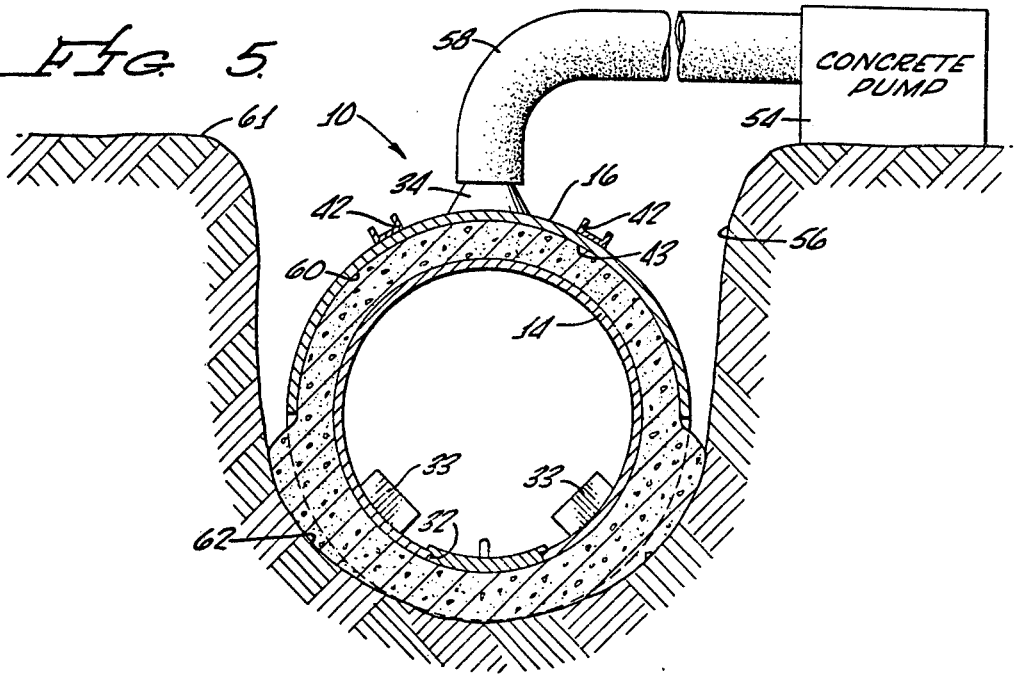
FIG. 5 is a sectional view taken along the lines 5—5 in FIG. 4.

As shown in FIG. 5, a concrete pump 54 can be located adjacent the trench 56 and is connected through a hose 58 to the entry port 34 in the skirt 16. The concrete pump supplies concrete into the space 60 established between the skirt 16 and the mandrel 14 and the space 62 between the trench 56 and the mandrel 14. The spaces 60 and 62 are contiguous. An exemplary concrete pump is a Whiteman P80D concrete pump.

It should be noted with respect to FIG. 3 that the attachment of the mandrel 14 to the support member 12 orients the mandrel 14 in a spaced relation above the bottom 64 of the trench 56. The orientation of the mandrel with respect to the trench and the skirt 16 is arranged to provide as equal a distribution of concrete around the complete circumference of the mandrel as possible. Included in the bottom of the mandrel 14 are inspection doors 32 which can be opened to check on the compaction of the concrete at the bottom of the newly formed pipe during the forming process. Because the mandrel is hollow, it allows for the utilization of such inspection doors. Furthermore, these doors 32 provide venting passages for any air which may become entrapped as the concrete is being placed around the mandrel.

Figure 4:
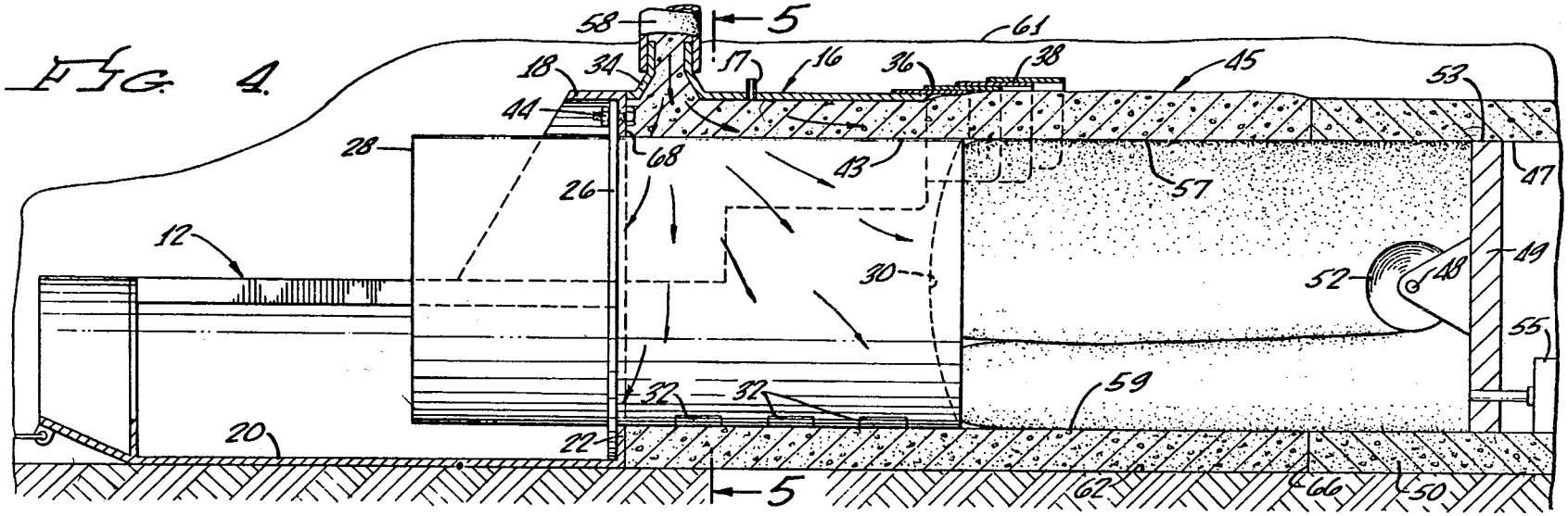
FIG. 4 is a partial side sectional view of the apparatus showing it in operation.

Turning to the operation of the apparatus 10 for the placement of continuous concrete pipe in a trench, reference is made to FIGS. 3 and 4. A precast piece 50 of concrete pipe or any cylindrical member of the same internal diameter of the pipe to be formed by the pipe forming apparatus 10 is placed at the starting point from where the run of making continuous in place formed concrete pipe is to begin. On the precast concrete pipe section 50 is located the reel 48 with the deployment bag 52 connected to an air supply source 55. The forming apparatus 10 is positioned adjacent the precast section of pipe 50 with the back edge or end 30 of the mandrel 14 located slightly within the precast pipe section 50. The mandrel is secured to the support section 12 through the use of the bolts 44 connecting flange 26 and the retaining flange 22. Also the skirt 16 is securely attached to the support section 12 by the connecting bars 42 and the bolts 46 as shown in FIG. 1. With this arrangement, an enclosed space is established completely around the circumferential surface of the mandrel 14 to the rear of the connecting ring 26. The space 60 is established between the skirt 16 and the mandrel 14 while the space 62 is established between the trench 56 and the mandrel 14.

As shown in FIG. 5, a concrete pump 54 has been attached to the entry port 34 in the skirt 16 by the hose or flexible tubing 58. When the process of forming the in place concrete pipe is to begin, high pressure concrete is pumped into and through the entry port 34 to flow into the contiguous spaces 60 and 62 which are confined by the forward edge 66 of the precast concrete pipe 50 and the back surface 68 of the retaining ring 22 of the support member 12. As the spaces 60 and 62 around the mandrel 14 are completely filled and compacted with concrete, the force of the high pressure concrete will increase against the back surface 68 of the retaining ring 22 on the support member 12. Being free to move on the trench flow 64, the support member 12 will proceed forward in the direction of the arrow shown in FIG. 4. Consequently, the forming apparatus will move forward in the trench 56 as the completely compacted and formed concrete is established in its pipe configuration to the rear of the apparatus. This assures that all of the necessary concrete has been placed uniformly and adequately around the mandrel to establish a satisfactory pipe configuration before the support member 12 moves forward. In some instances, it may be necessary to utilize a wench 65 connected through cable means 67 to said base support member forward section 20 to assist in pulling the boat forward if too much concrete is being forced out from under the flange arrangement 38 of the skirt 16. Further, it is desirable to use electrical surface vibrators 33 as shown in FIG. 5 on the inside of the mandrel 14 to encourage the concrete to move down around to the bottom of the mandrel.

In order to provide the adequate interior support of the newly formed concrete pipe as the mandrel moves forward, the bag 52 is in position to immediately occupy the space within the newly formed concrete pipe vacated by the mandrel. Therefore, as the mandrel moves forward along the trench, the deployment bag 52 will unroll from the reel 48 through the use of the air pressure to provide necessary support to maintain the internal integrity and diameter of the concrete pipe until it has sufficient time to set. Because this deployment bag is deployed to the rear of the forming apparatus, it encounters no irregularities or obstructions during its movement, allowing the bag to be preferably made of rather inexpensive and thinner plastic material.

FIG. 5 shows more clearly in sectional view how the concrete is placed between the internal support member or mandrel 14 and the upper exterior support member or skirt 16 and the lower exterior support member or trench 56. It should be noted that the exterior diameter of the mandrel 14 establishes the interior diameter of the pipe which through this process of in place continuous forming provides a smooth interior surface throughout the run of the pipe with no seams or irregularities. Furthermore, the general thickness of the in place formed concrete pipe is generally uniform throughout its longitudinal run eliminating significant waste in the use of the concrete.

Figure 6:
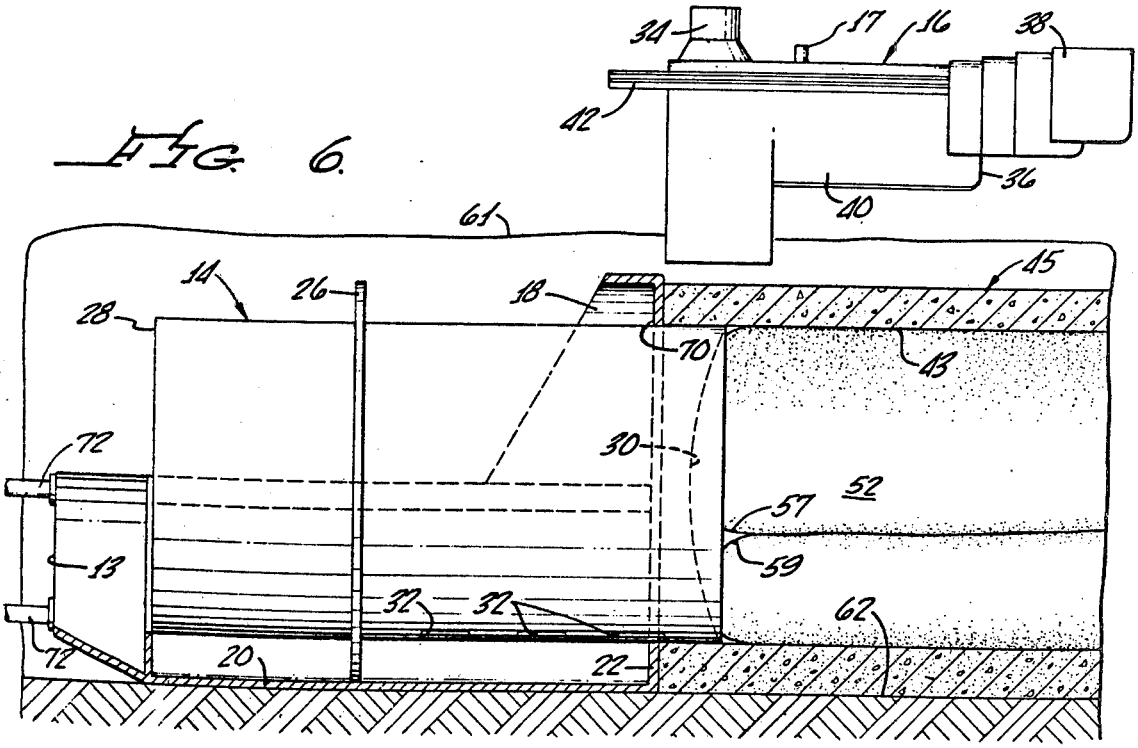
FIG. 6 is a partial sectional view of the forming apparatus arrangement during a temporary stop in the forming of pipe.

During the operation of the apparatus 10, it may be necessary to temporarily stop the operation for an hour or two for a lunch break or a minor equipment check or repair. However, it is desirable not to have to completely remove the forming apparatus 10 from the trench, since this would be very time consuming and inefficient in the overall operation of the forming apparatus. With reference to FIG. 6, the present forming apparatus is constructed in order to provide for temporary stopping of the operation during the run of forming a concrete pipe without having to completely remove the apparatus from the trench. When a temporary stop is necessary, the connecting flange 26 on the mandrel 14 is disconnected or unbolted from the retaining flange 22 on the support member 12. The mandrel 14 is then moved relative to the base support member 12 approximately twenty inches to the position shown essentially in FIG. 6. Because of the increased pressure by the support bag 52 behind the end wall 30 of the mandrel 14, the mandrel will generally move automatically relative to the base support member 12 once it is unbolted from the retaining flange 22. However, in some cases it may be necessary to pull the mandrel in order to move it relative to the base support member 12 due to the friction forces of the wet concrete on the mandrel surface.

The retaining ring 22 retains the integrity of the newly formed concrete pipe while the mandrel is being pulled out from inside of the newly formed concrete. This movement of the mandrel out of the pipe can be equated to removing a cork from a bottle. Consequently, it is very important that the base support member 12 remains stationary while the mandrel 14 is being moved out from within the concrete pipe. Otherwise, the tight friction forces between the surface of the mandrel and the newly formed concrete would cause tearing and damage to the concrete pipe. In order to maintain the stationary position of the base support member 12, it may be necessary to utilize hydraulic jacks or some type of holding arrangement 72 against the front edge 13 of the base support member 12. It should be noted that the mandrel 14 is not pulled completely free of the new pipe, but only to the position as depicted in FIG. 6. After the mandrel has been moved, the skirt 16 is unbolted from the support member 12 and removed from above the newly formed concrete. This is necessary in order to completely purge the entry port 34, so that no concrete sets up within the port which may block the future flow of concrete.

Once a lunch break has expired or repair work is completed and the formation run is to be reinstituted, the base support member 12 is moved forward relative to the mandrel 14 until the retaining ring 22 and the connecting ring 26 are adjacent each other for securely bolting them together as shown in FIG. 3. However, if the concrete has not firmly set, it is extremely important that the mandrel 14 remains stationary while the base support member 12 is moving forward, because the removal of the retaining ring 22 away from the forward edge 70 of the newly formed concrete results in no restraining wall against that edge of the concrete to maintain the integrity of the pipe form if the mandrel would move. The same type of anchoring or holding means 72 can be used against the forward edge 28 of the mandrel to keep it stationary. Once the mandrel is connected to the base support member 12, the skirt 16 is bolted onto the base support member 12 and the device is again in the orientation essentially as shown in FIG. 3 ready for the introduction of high pressure concrete to continue the forward movement of the device through the trench.

With respect to the flange arrangement 38 on the skirt 16 shown in FIG. 4, when the high pressure concrete is being forced into the contiguous spaces 60 and 62, it tends to spread out quickly and under high force. Consequently, it may tend to relieve itself rather abruptly and unevenly affecting the compaction of the concrete in areas such as the rear edge 36 of the skirt 16 without the flange arrangement 38. However, the flange arrangement 38, containing a series of semi-cylindrical plates in stepped relation, allows for the gradual tapering and relief of the high pressure concrete as it is formed. This insures a better compaction and conservation of the concrete. Similar to the flange arrangement 38 on the skirt 16 adjacent the back edge 36 are the side flanges 40 shown in FIG. 2 to provide a more gradual release of the high pressure concrete as it is being formed around the mandrel and give a better compaction along the side of the mandrel to provide a more uniform taper into the area of pipe being formed between the mandrel and the trench itself.

When the concrete run is completed, the procedure with respect to the temporary stop is repeated except that the mandrel 14 is completely removed from within the concrete pipe. Once the concrete has had sufficient time to set and maintain its own integrity and strength, the support bag 52 as well as the entire unit comprising the base support member 12, the mandrel 14 and the skirt 16 are removed from the trench.

During the process of formulating the in place concrete, the inspection ports or doors 32 within the hollow mandrel allow the operator to continuously check to assure the proper placement and compaction of the concrete during the entire run. This provides the operator the opportunity to stop the operation if it appears that the pipe is not being formed correctly rather than waiting until the entire run is completed and learning that the concrete pipe had not been formed correctly.

What is claimed is:

1. A method of temporarily stopping the process of forming in place concrete pipe in a trench using an apparatus comprising an interior forming member, an upper exterior forming member and a connecting support member without having to completely remove said apparatus from said trench, said support member having its rear portion holding said inner forming member spaced from the trench bottom and the exterior member to define a tubular space and including a wall defining the forward end wall of the space, said concrete being introduced under pressure from a source external said members, said method comprising the steps of:

stopping the flow of concrete into said space;

disconnecting said interior forming member from said support member;

holding said support member in a stationary position with said end wall supporting the end of the newly formed pipe;

moving said interior forming member forward relative said support member; and removing said exterior forming member from said support member.

2. A method of forming in place concrete pipe with a pipe forming apparatus and for allowing stops during said forming without having to completely remove said apparatus from adjacent said pipe, said method comprising the steps of:

positioning an internal form member connected to the rear of a support member which holds the form member spaced from the surface of a trench and forms an annular forward end wall;

positioning an external form member spaced over said internal form member adjacent the top of said trench;

introducing concrete into said space between said internal form member and said trench and between said internal form member and said external form member, said space being open on its rear end and bounded by said end wall on its forward end;

moving said internal and external form members forward in said trench as said concrete is compacted in said space;

stopping said introduction of concrete into said space ceasing said forward movement of said internal and external form members;

disconnecting said internal form member from said support member;

holding said support member stationary adjacent said pipe;

moving said internal form member forward through said support member end wall to a temporary position where said internal form member remains partially within said pipe;

holding said internal form member stationary in said temporary position when the pipe forming process is to be resumed;

moving said support member forward adjacent said temporary position of said internal form member;

attaching said internal form member to said support member;

introducing concrete into said space;

moving said internal and external form members forward as said concrete is compacted in said space.

* * * * *